US008876084B1

(12) United States Patent
Erwin et al.

(10) Patent No.: US 8,876,084 B1
(45) Date of Patent: Nov. 4, 2014

(54) ROLLING FLOOR JACK SAFETY DEVICE

(71) Applicants: Andrew Erwin, Loxahatchee, FL (US); Oscar Herrera, Wellington, FL (US)

(72) Inventors: Andrew Erwin, Loxahatchee, FL (US); Oscar Herrera, Wellington, FL (US)

( * ) Notice: Subject to any disclaimer, the term of this patent is extended or adjusted under 35 U.S.C. 154(b) by 0 days.

(21) Appl. No.: 14/120,033

(22) Filed: Apr. 17, 2014

Related U.S. Application Data

(60) Provisional application No. 61/892,430, filed on Nov. 18, 2013.

(51) Int. Cl.
*B66F 5/04* (2006.01)
*B66F 17/00* (2006.01)

(52) U.S. Cl.
CPC .. *B66F 5/04* (2013.01); *B66F 17/00* (2013.01)
USPC ..... 254/8 B; 254/2 B

(58) Field of Classification Search
USPC ... 254/122, 124, 2 B, 133 R, 93 R, 89 H, 8 B
See application file for complete search history.

(56) References Cited

U.S. PATENT DOCUMENTS 5,221,073 A * 6/1993 Shockley ..... 254/8 B
5,618,029 A * 4/1997 Chung ..... 254/8 B
5,711,512 A * 1/1998 Kauffman ..... 254/2 B
5,984,270 A * 11/1999 Hussaini et al. ..... 254/8 B
6,331,091 B2 * 12/2001 Cross ..... 403/322.2
6,416,039 B1 * 7/2002 Pietrusynski ..... 254/8 B
6,848,673 B1 * 2/2005 McLaughlin et al. ..... 254/8 B
6,902,148 B1 * 6/2005 Spencer ..... 254/93 H
8,662,476 B2 * 3/2014 Weddle ..... 254/93 H
2008/0173852 A1 * 7/2008 Woodbury et al. ..... 254/8 B
2012/0223280 A1 9/2012 Zhou

* cited by examiner

*Primary Examiner* — Lee D Wilson

(57) ABSTRACT

This invention relates to light to heavy duty automotive repair practices in which repairs are required to use a rolling hydraulic floor jack. The rolling floor jack has a safety pin device with adjustable hole locations for different heights to accommodate the end user. The rolling floor jack lifting arms would be supported by the safety pin device. When the safety pin device is inserted thru the holes in the sides of the body side panels of the jack, there is a spring loaded release safety ball built into it to also in sure the safety pin is properly inserted and not slide out. The safety pin device has a side storage (cradle) mounted to the right side panel to store it when not in use. The safety pin device has a safety chain attachment connected to it and the other end of the safety chain attachment is connected to the right side panel to help the end user from misplacing it or losing it. This rolling floor jack safety pin device is a feature that will support any automotive vehicle or heavy equipment if and when the hydraulic jack internal seals fail or hydraulic fluid leakage. This can cause a sudden drop of the lifting arms and allow the lifted automotive vehicle or heavy equipment to move downward in which the safety pin device will stop the movement from the rolling floor jack lifting arms from collapsing totally.

5 Claims, 4 Drawing Sheets

Rolling Floor Jack Safety Device

METAL

METAL

Rolling Floor Jack Safety Device

METAL

Rolling Floor Jack Safety Device

METAL

Rolling Floor Jack Safety Device

Rolling Floor Jack Safety Device

ROLLING FLOOR JACK SAFETY DEVICE

CROSS REFERENCE TO RELATED APPLICATION

This application claims the benefits of U.S. Provisional Patent No. 61/892,430, filed on Nov. 18, 2013, the entirety of which is hereby incorporated by reference.

TECHNICAL FIELD

This invention relates to a rolling floor jack having a safety pin device mechanism.

Examples of hydraulic floor jacks may be found in U.S. Patent No. 2008/0173852 A1, 2012/0223280 A1.

BACKGROUND OF THE INVENTION

This invention relates to a rolling floor jack for automotive vehicles and heavy equipment repair practices, particularly to a rolling floor jack with a safety pin device.

During a automotive vehicle and heavy equipment repair practices, an automotive and heavy equipment rolling floor jack is used regularly to raise a small vehicle or large vehicle so they may be serviced or parts replaced. The conventional rolling floor jack generally includes a base with round metal wheels, a hydraulic pump, a hydraulic cylinder in which hydraulic oil pushes a rod to allow the lifting arms to move and support the load on the platform. The rolling floor jack is engaged by long tubular handle to either block or release hydraulic fluid in the hydraulic pump. There can be an issue using a rolling floor jack that does not have a safety pin device feature. The hydraulic internal seals carrying all of the loads being applied can fail, this can cause premature leak down and drifting of the supported loads to collapse slowly or suddenly with out warning in which can cause serious injury and or death.

The resolution to this issue; some rolling floor jack systems have a complex of modifications. These types are a ratchete type gear system or a sliding gear type system that is used as a safety device. These gears wear out over time and there is no adjustment for gear lash.

The rolling floor jack safety device is the resolution to all the rolling floor jacks that are powered by a hydraulic oil system. This rolling floor jack safety device that has been designed by and invented by the joint inventors have come up with this type of safety device to help all the end users to be safe and manufactors to add our invention to all there rolling hydraulic floor jacks for the world to use.

The rolling floor jack safety device is a safety pin device that is an invention that will resolve issues with the rolling floor jacks out on the market due to hydraulic seals or hydraulic pump failures.

The background of the rolling floor jack safety device came from the understanding of how a rolling floor jack system works. The rolling floor jack is made to lift a certain amount of weight. All rolling floor jacks are not meant to support an automotive vehicle or heavy equipment for a prolonged time period. This will put a lot of pressure on the internal seals of the hydraulic system. The rolling floor jack safety pin device will allow the end user to lower the automotive vehicle or heavy equipment so that the lifting arms make contact to the safety pin device when inserted thru the holes in the side panels.

BRIEF SUMMARY OF THE INVENTION

The main purpose of this invention is to solve the aforementioned issues while providing really easy addition to all rolling floor jacks that has the characteristics of great engineering concepts for safety practices and with being user friendly.

The features of this rolling floor jack safety device is that when being used is that the end user positions the rolling floor jack under the automotive vehicle or heavy equipment to be lifted. The end user then decides the certain heights needed to allow access for work to be performed. The safety pin device can be installed and then can start to lower the lifting arms to make contact with the safety pin device.

The rolling floor jack when needed can be carried or rolled to the work location, then positioned under the automotive vehicle or heavy equipment to be lifted.

The rolling floor jack tubular handle would then be rotated clock wise to block the hydraulic fluid from returning to reservoir tank.

Then as the tubular handle is raised, this allows the hydraulic fluid to extend the hydraulic cylinder rod as each movement of the tubular handle makes one complete stroke from up position to the down position and returns to the up position.

This is to where the end user decides how high the rolling floor jack must lift the automotive vehicle or heavy equipment to be in order to do his or her job task at hand. At that given time the safety pin would be removed from the on board storage attachment (cradle) that the safety pin device is stored in when not in use and it is located on the right side panel.

When the safety pin device is removed from the on board storage attachment (cradle), there is a safety chain attached to it and is as well connected to the right side panel. The safety pin device chain attachment will allow plenty of movement to fully remove the safety pin device from the on board storage attachment (cradle) as well to insert it into any given hole locations that the end user decides to use. The hole locations are located on the right and left side panels.

The safety pin would be pushed thru the hole openings located on the right and left side panels and the end user feeling the locking ball release as to allow the safety pin to continue thru and fully being seated after inserted in to the other side panel hole locations.

The end user would in this next procedure would turn the tubular handle counter clockwise to release hydraulic oil back into the reservoir tank. This will allow the hydraulic cylinder rod to retract and lower the lifting arms and platform. This will allow the weight to be transferred onto the safety pin device.

When the automotive vehicle or heavy equipment is lowered and supported the safety pin device will take all of the hydraulic oil pressure off the internal seals. This safety pin device will save time and money for parts and repairs of damaged seals due to hydraulic oil pressure continuing being applied. The end user can now proceed to make repairs or replace parts as needed.

The rolling floor jack can be removed from the automotive vehicle or heavy equipment in reverse order stated above when the end user has completed the repairs or part replacement.

BRIEF DESCRIPTION OF THE DRAWINGS

A detailed description of this is hereafter described with specific reference being made to the rolling floor jack safety device drawings.

DETAILED DESCRIPTION OF THE DRAWINGS

The following detailed description of this invention shows the views of the figures.

Figure 1:
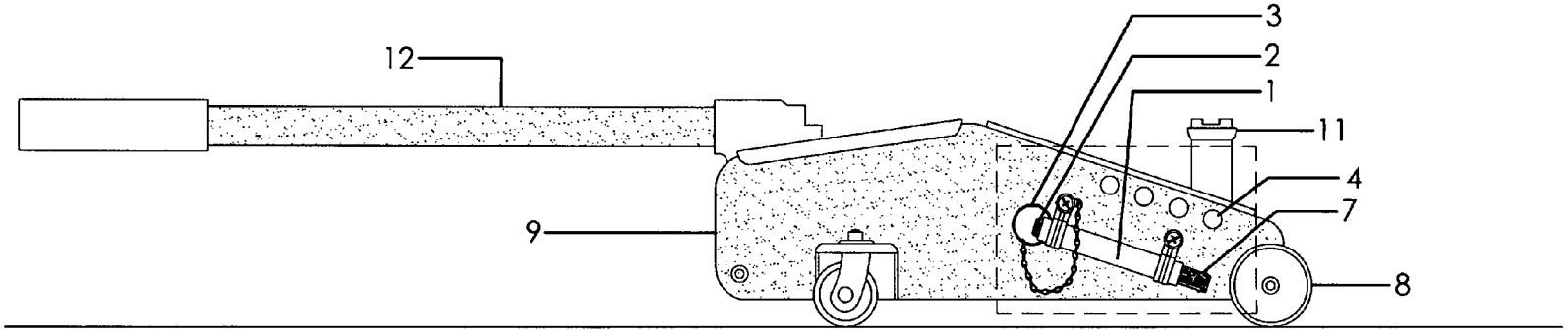
FIG. 1 is showing a right side view of the rolling floor jack in the (down position). This also shows the safety pin device inserted into the side storage attachment (cradle) with the safety pin device attachment chain connected to the right side panel and safety pin device. This side view is also showing the safety pin hole locations in the right side panel.

As shown in FIG. 1 this will show a rolling floor jack with metal round wheels reference 8 with a base like frame body reference 9. Within this base like frame body reference 9 there is a hydraulic oil pump, a hydraulic oil reservoir, a hydraulic cylinder rod end. To engage the operations of these functions, the tubular handle reference 12 would be twisted clockwise or counter clockwise to release or block hydraulic fluid in the hydraulic pump.

Figure 2:
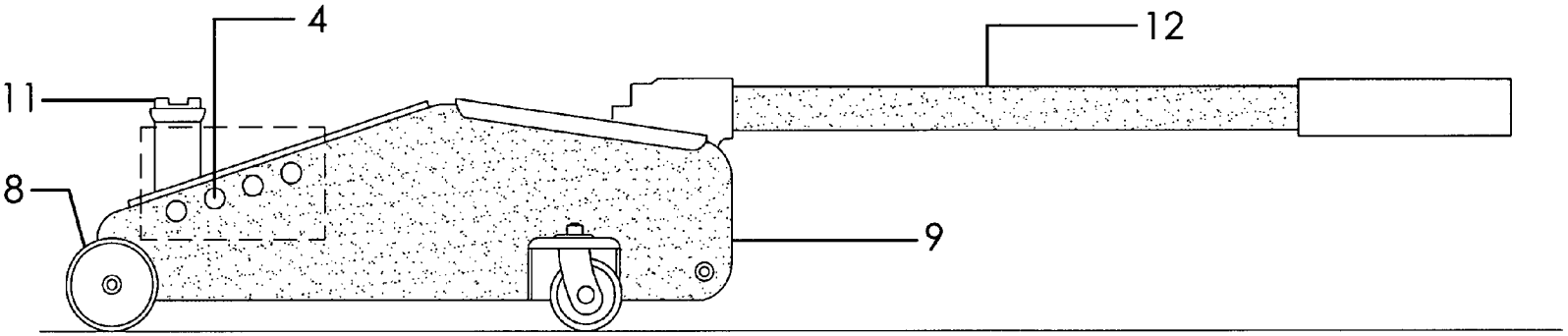
FIG. 2 is showing the left side view of the rolling floor jack in the (down position). This view also shows the safety pin device insert hole location opening in the left side panel.
Figure 3:
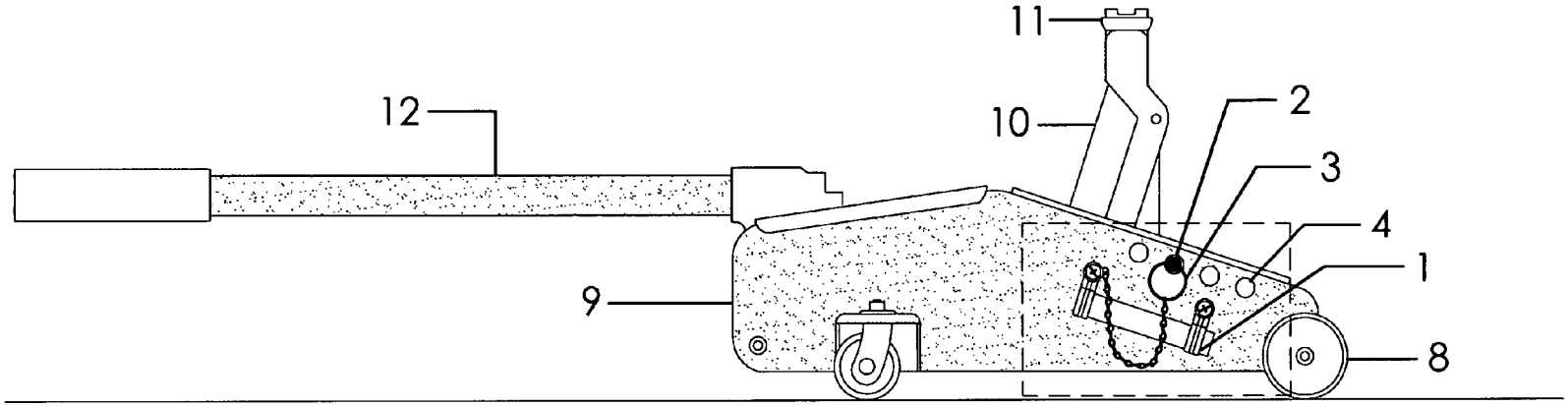
FIG. 3 is showing the right side view of the rolling floor jack in the (up position). This view also shows the safety pin device inserted in the $3^{rd}$ hole location. This view continues to show the safety pin device attachment (chain) connected to the safety pin device at the right side panel.
Figure 4:
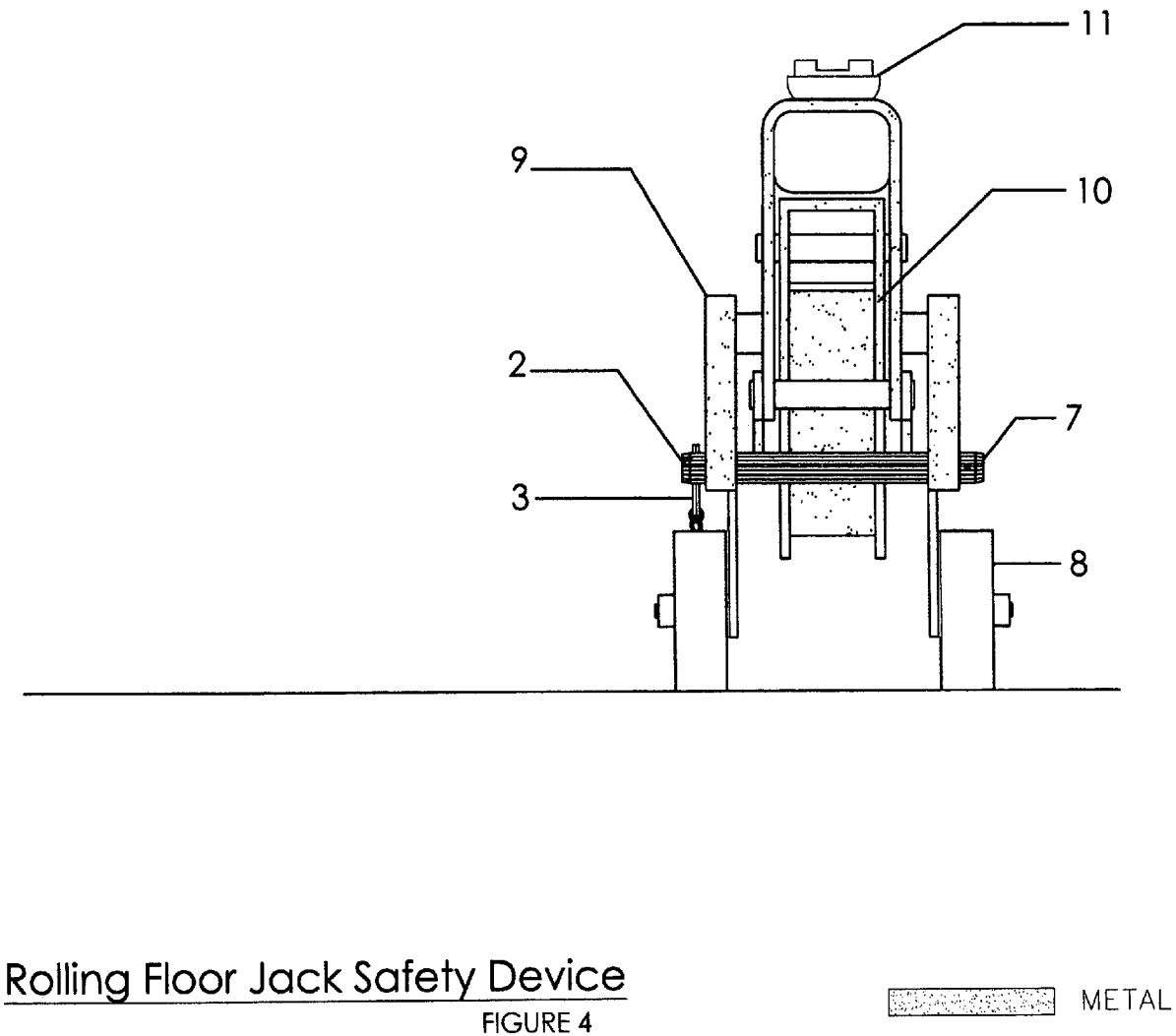
FIG. 4 is showing the front view of a rolling floor jack in the (up position). This view also shows the safety pin device inserted fully from the right side panel hole insert location to the left side panel insert location. This view continues to show that the lifting arms making contact to the safety pin device as well the spring loaded release ball engaged to keep the safety pin device from sliding out.

The detailed description of this invention is FIG. 1, FIG. 3 and FIG. 4 will show we added the safety pin device system reference 2 as detailed. FIG. 1, FIG. 2 and FIG. 3 shows the rolling floor jack having a safety device insert openings reference 4 installed to both the left and right side panels reference 9 of the drawings. FIG. 1, FIG. 3 and FIG. 4 shows the rolling floor jack has a safety pin device attachment (chain) reference 3. FIG. 1, FIG. 3 and FIG. 4 shows a safety pin device reference 2. FIG. 1, FIG. 3 shows a safety device side storage (cradle) reference 1 of the drawings. FIG. 1 and FIG. 4 shows a spring loaded safety release ball reference 7 installed into the safety pin reference 2.

As shown in FIG. 1, FIG. 2 and FIG. 3 the tubular handle reference 12 would then be raised up and pushed down in a pumping action motions.

As shown in FIG. 3, FIG. 4 the lifting arms are in the (up position) reference 10 and also the platform reference 11.

The rolling floor jack safety device detailed descriptions shows in FIG. 1 and FIG. 3 the safety pin attachment (chain) reference 3 connected to the right side panel reference 9 and also connected to the safety pin device reference 2. FIG. 1 and FIG. 3 shows the safety pin device attachment (chain) reference 3 is held in place by a hold down screw that is part of the mounting system for the safety pin device reference 2 and the side storage (cradle) reference 1.

The rolling floor jack safety device detailed description shows in FIG. 1 and FIG. 3 that the safety pin device attachment (chain) reference 3 is connected with a metal round ring to where it is then attached thru a drilled hole in the safety pin device reference 2.

The rolling floor jack safety device detailed description in FIG. 1 and FIG. 3 shows a safety side storage (cradle) reference 1 in which it's attached by two hold down screws and holes drilled thru the right side panel reference 9 to secure in place.

The rolling floor jack safety device detailed description shows in FIG. 3 and FIG. 4 the safety pin device reference 2 inserted into a hole location and thru the right and left panels reference 9.

The rolling floor jack detailed description in FIG. 1 and FIG. 4 shows the spring loaded safety release ball built into the safety pin device reference 7. This added feature is to keep the safety pin device reference 2 in place when inserted thru both the right and left side panels reference 9.

The rolling floor jack safety device detailed description in FIG. 3 shows that the lifting arms reference 10 and the platform reference 11 in the (up position) with the safety pin device reference 2 inserted thru the $3^{rd}$ hole location reference 4.

The rolling floor jack safety device detailed description in FIG. 4 shows the safety pin device reference 2 inserted thru the right and left side panels reference 9 with the lifting arms reference 10 and platform reference 11 in the (up position) in which is making contact to the safety pin device reference 2.

The invention claimed is:

1. A rolling floor jack comprising of metal wheels; a base with side panels; a lifting arm system; a platform connected to the lifting arms; a hydraulic pump; a hydraulic reservoir; a hydraulic cylinder rod end; a tubular handle; a safety pin device; wherein the safety pin device comprises a built in spring loaded release safety locking ball; a safety chain attachment connected to the right side panel, a first hole; a second hole; a third, hole; a fourth hole with the safety pin device inserted in to either hole locations, and also connected to the safety pin device; a side storage (cradle) connected to the right side panel to store safety pin device; a right and left side panels with holes to accept the safety pin device.

2. A rolling floor jack of claim 1; comprising of lifting arms having support when in contact with safety pin device.

3. A rolling floor jack of claim 1; comprising of a spring loaded release safety locking ball inserted in to the safety pin device.

4. A rolling floor jack of claim 1; comprising of a safety chain attachment connected to the right side panel and safety pin device.

5. A rolling floor jack of claim 1; comprising of a side storage (cradle) connected to the right side panel to store safety pin device.

* * * * *